United States Patent [19]

Samal et al.

[11] 4,134,800

[45] Jan. 16, 1979

[54] PROCESS FOR ELECTROLYTIC IRON POWDER

[75] Inventors: Prasanna K. Samal, Lyndhurst; Erhard Klar, Beachwood, both of Ohio

[73] Assignee: SCM Corporation, New York, N.Y.

[21] Appl. No.: 858,090

[22] Filed: Dec. 7, 1977

[51] Int. Cl.[2] ..... C25C 5/02

[52] U.S. Cl. ..... 204/10; 204/48

[58] Field of Search ..... 204/10, 112, 48

[56] References Cited

U.S. PATENT DOCUMENTS

| | | | |
|---|---|---|---|
| 2,464,168 | 3/1949 | Balke | 204/10 |
| 2,481,079 | 9/1949 | Casey | 204/10 |
| 2,626,895 | 1/1953 | Balke | 204/10 |

*Primary Examiner*—G. L. Kaplan

*Attorney, Agent, or Firm*—Thomas M. Schmitz

[57] ABSTRACT

An improved process for producing electrolytic iron is primarily based on maintaining the electrolytic bath at a low concentration of ferrous sulfate ions in combination with a certain concentration of $NH_3$ and pH in the electrolytic bath. The electrolytic iron chips produced in accordance with this process are much more friable. A substantial improvement is obtained in an efficient grinding of the chips to −100 mesh (Tyler Screen) and smaller.

3 Claims, No Drawings

PROCESS FOR ELECTROLYTIC IRON POWDER

BACKGROUND OF THE INVENTION

This invention relates to electrolytic iron for metallurgical purposes and particularly to a process for producing thick, dense, friable iron deposit chips on the cathode surface by electrolytic deposition which can be easily removed from the cathode and ground to fine mesh size powder. The process of this invention produces improved quality iron chips that substantially improves the yield fraction of very fine powders. Electrolytic iron powders produced by this process are particularly advantageous as being highly pure powders substantially free from metallic and nonmetallic impurities.

Electrolytic iron is produced by electrolytic deposition of metal from an aqueous solution of a suitable iron electrolyte whereby metal is deposited onto a cathode and can be subsequently chipped off or stripped off the cathode and ground into fine powder. To obtain desirable grinding properties of the electrodeposited chips, the chips are preferably dense, brittle deposits and ordinarily require relatively low current density and an electrolyte of relatively low acidity. The electrolytic iron deposited and subsequently utilized for powder metallurgy purposes is quite brittle and has low ductility so that the electrodeposited iron can be readily removed from the cathode and reduced mechanically to a pulverized powder form. The metallographic grains of dense brittle deposits of metal chips ordinarily are irregular or needle-like and are particularly suitable for subsequent mechanical pulverization in one or more steps, such as by grinding in large and small ball mills.

It now has been found that particularly brittle, friable iron chips can be produced in accordance with this invention from aqueous electrolytic baths containing lower concentrations of ferrous sulfate, maintaining a much higher concentration of ammonium sulfate, a lower concentration ratio of ferrous sulfate to ammonium sulfate in the electrolytic bath solution while maintaining pH control of the electrolytic bath. The electrolytic iron deposited onto the cathode is brittle and friable and can be efficiently removed from the cathode. The chips removed can be easily mechanically pulverized into fine powder of less than about −100 mesh (149 microns) wherein the fraction of iron powder below −324 mesh (44 microns) is approximately tripled in comparison to prior known processes.

SUMMARY OF THE INVENTION

Briefly, an electrolytic iron process for producing brittle, friable iron chips suitable for mechanical grinding into very fine powder, comprises the steps of providing an electrolytic cell having an iron or steel anode and a stainless steel cathode wherein the electrolytic bath contains between about 36 and 40 grams of ferrous ion (ferrous sulfate) per liter concentration and between about 24 and 28 grams of ammonia ion (ammonium sulfate) per liter concentration wherein the weight ratio of ferrous ion to ammonia ion is approximately 1.4–1.6 and the pH of the electrolyte is 5.6 to 6.0. High purity grade iron is electrodeposited on the cathode, removed from the cathode, and subsequently mechanically pulverized to produce extremely fine iron powder wherein the weight fraction of iron powder below −325 mesh (44 microns) can be substantially increased.

DETAILED DESCRIPTION

In accordance with this invention, the electrolytic cell conditions are adjusted within critical limits to provide certain low concentrations of ferrous sulfate, together with certain high concentrations of ammonium sulfate so that the ratio of ferrous ion to ammonia ion ($NH_3$) is approximately about 1.5, and broadly between about 1.4–1.6 on a weight basis. The total iron content of the ferrous sulfate electrolyte measured as ferrous ion is greater than 34 grams/liter and preferably between about 36 and 40 grams per liter concentration of aqueous electrolytic bath. Similarly, ammonium sulfate concentration is less than about 28 grams/liter measured in the form of ammonia ion concentration and is preferably between about 24 and 28 grams of ammonia ion ($NH_3$) per liter concentration on the total volume of the electrolytic bath solution. Although not critical, the resulting concentration ratio of ferrous ion to ammonium ion in the electrolytic bath aqueous solution can be between about 1.4–1.6 and preferably about 1.5 provided the ferrous ion concentration is at least 34 grams/liter and the ammonia ion ($NH_3$) concentration is less than 28 grams/liter. The pH of the aqueous electrolytic solution containing the ferrous and ammonium ions in the form of sulfates is at least about 5.6 and preferably between about 5.6 and 6.0. The pH of the electrolytic solution can be optimized wherein the power consumption required to deposit metal on the cathode is at an efficient rate of power consumption per weight basis of iron deposited. The average bath temperature is between about 100° F. and 120° F. (38° C. to 49° C.) for the duration of the electrodeposition. Improvement in grindability is believed to be obtained by the formations of small amounts of iron hydroxide in a thin layer of electrolyte disposed approximate to the cathode and apparently becomes entrapped by the iron deposit along the grain boundaries of the deposit. In addition to the formation of iron hydroxide adjacent to the cathode, finer grain sizes in the iron deposit are apparent near the cathode. Brittleness is believed to be further increased by hydrogen absorbed by the iron produced throughout the deposition process, although primary improvement appears to be obtained by the iron hydroxide formation.

The cathode current density in the electrolytic bath system is not critical, although preferably between 18 and 26 amperes per square foot of cathode is desirably utilized to avoid excessive heating of the electrolyte and to avoid excessive formation of dendritic-tree growths on the cathode and yet maintain a useful electrolytic deposition rate. The cathode can be stainless steel and the anode for the electrolytic bath can be a relatively impure iron or steel, even if the electrolytic iron is to be substantially pure electrolytic iron. The temperature of the electrolytic bath is preferably between about 100° F. and 120° F. so as to maintain a stable electrolytic bath solution without precipitation of the sulfate salts but still promote deposition of brittle iron onto the cathode. Preferably the friable iron is deposited from the electrolytic bath on the cathode and built up to a suitable thickness of about 1/18 inch thickness or more which can be removed by mechanical jarring to form iron chips. The iron chips ordinarily can be expediently reduced to powder by mechanical milling such as ball milling and/or hammer milling.

The cost of pulverizing electrolytic iron chips into powder is quite high to the extent of being a significant cost factor in the overall process. However, the process in accordance with this invention provides a substantial improvement in grindability or friability of the electrolytic iron chips formed on the cathode by adjusting the critical electrolytic cell conditions whereby the grindability efficiency can be substantially increased in comparison to conventional electrolytic process and quantitatively the weight fraction of very fine powder in the −325 mesh size fraction is increased about three-fold.

The advantages of this invention are further illustrated by the following examples.

EXAMPLE I

An aqueous electrolytic bath was prepared having the following composition wherein the approximate concentrations are a per liter basis.

| | |
|---|---|
| Ferrous ion concentration | 38 gm/liter |
| Ammonia concentration | 26 gm/liter |
| pH | 5.6 to 5.8 |
| Bath temperature | 100° F to 100° F (40° C) |
| Current density | 22 amp/sq. ft. of cathode |
| Anode material | Armco iron |
| Cathode material | Stainless steel |
| Electrodeposition duration | 4 days |

During the electrolysis the actual cathode current density varied about 10% with increased current density relating to greater increase in cathode surface area as the iron deposit increased on the cathode. The average power consumption was about 0.65 kilowatt hours per pound of iron produced. The iron produced was about ⅛ inch in thickness which was then chipped off the cathode and ground by milling. The chips of electrolytic deposit were substantially free of dendritic growths. The chips were reduced with a steel mortar and pestle to −¼"/+7 mesh (Tyler Screen) size and then fed into a hammer mill under nitrogen atmosphere at the rate of one chip per three seconds. The hammer mill was produced by Mikropulverizing Company having a 4.3" diameter chamber with three hammers rotating at a tip speed of 9,700 feet per minute. The output of the hammer mill (100 grams) was then charged into a ball mill of 8" diameter and 4" depth under Argon atmosphere and was run for 24 hours at a speed of about 50 rpms.

EXAMPLE II

A conventional electrolytic prior art process was produced in an aqueous electrolytic bath prepared from the following components.

| | |
|---|---|
| Ferrous ion concentration | 50 gm/liter |
| Ammonia ion concentration | 13 gm/liter |
| pH | 5.4 |
| Bath temperature | 100° to 110° F |
| Current density | 22 amp/sq. ft. of cathode |

The prior art bath was processed in accordance with Example I except as indicated to produce electrolytic iron deposits on the cathode. The deposits were subsequently chipped off the cathode and pulverized in accordance with Example I.

EXAMPLE III

Table I hereinbelow indicates the comparative results of the pulverizing chips produced in Examples I and II respectively as a function of the quantitative determination of the weight percent of iron powder produced. Table I indicates the percent of the fine powder fraction produced (−325 mesh) in Example I in accordance with this invention. The −325 mesh fraction is more than tripled and comprises nearly 80% by weight of the original chips starting material. The powder produced in accordance with Example I was particularly suitable for powder metallurgy purposes.

TABLE I

| Screen Size, Mesh | Improved Cell Material (Ex. 1) | Standard Cell Material (Ex. 2) |
|---|---|---|
| +80 | 0% | 66.5% |
| −80,+100 | 2.92% | 2.5% |
| −100,+140 | 0.47% | 0.45% |
| −140,+200 | 1.45% | 1.21% |
| −200,+270 | 8.81% | 2.72% |
| −270,+325 | 6.85% | 1.67% |
| −325 | 79.50% | 25.07% |
| Total | 100.00% | 100.00% |

EXAMPLE IV

In a manner comparable to Example I-111, several electrolytic bath processes were conducted under the following indicated processing conditions. The iron chips were pulverized providing a weight percentage distribution of powder sizes as measured by Tyler Screen. Process conditions A, B and C are similar to those practiced earlier and Process conditions D, E and F are in accordance with the present invention.

TABLE 2

| | Anode materials-Armco iron Cathode-Stainless Steel Duration of Deposit- 4 days | | | | | |
|---|---|---|---|---|---|---|
| Process Conditions | A | B | C | D | E | F |
| Ferrous (conc.gm/liter) | 50–60 | 64–70 | 31–34 | 31–35 | 31–34 | 34–40 |
| $NH_3$(conc.gm/liter) | 15 | 26–31 | 26–29 | 26–29 | 28–29 | 24–30 |
| pH | 5.6–6.0 | 5.6–5.8 | 6.3–6.4 | 5.5–5.8 | 5.8–6.2 | 6.0 |
| Bath temperature (° F) | 100–110 | 100–106 | 100–110 | 100–110 | 100–110 | 100–110 |
| Current density (amp/sq.ft.) | 20 | 22 | 20 | 20 | 20 | 20 |
| Grind Results (Screen Mesh) | A | B | C | D | E | F |
| +80 | 12.7% | 21.2% | 28.1% | 11.2% | 12.3% | 3.2% |
| −80,+100 | 3.5% | 12.0% | 3.0% | 1.4% | 2.4% | 1.4% |
| −100,+140 | 18.1% | 10.3% | 5.7% | 3.4% | 5.8% | 3.3% |
| −140,+270 | 7.7% | 17.1% | 18.9% | 14.2% | 15.1% | 12.2% |
| −270,+325 | 26.3% | 8.9% | 11.4% | 6.1% | 6.4% | 10.5% |
| −325 | 31.0% | 20.5% | 32.9% | 63.7% | 58.4% | 69.5% |

The foregoing examples illustrate the merits of the electrolytic process of this invention wherein thick, dense and brittle iron metal is deposited on a cathode substrate. The deposits are highly pure and free of contamination and are particularly brittle, dense, thick deposits without excessive roughness. The deposits can be expediently pulverized into very fine powder having a preponderance (over 50% by weight) of particles less than 44 microns and preferably at least about 70% by weight of particles less than 44 microns. The examples are not intended to be limiting except by the appended claims.

We claim:

1. In an improved process for producing electrolytic iron powder from an aqueous electrolytic bath having an anode and a cathode and an electrolytic cell disposed between the anode and cathode, depositing electrolytic iron onto said cathode at a current density between about 10 amps and 30 amps per square foot of cathode surface, removing the deposited iron from the cathode as iron chips, and pulverizing the iron chips into powder to provide a preponderance of iron powder particles less than −325 mesh (44 microns), the improvement in the electrolytic process comprising:

providing an aqueous electrolytic bath containing ferrous sulfate at a ferrous ion concentration between about 36 grams and 40 grams of ferrous ion per liter and ammonium sulfate measured as ammonium ion ($NH_3$) concentration of between about 24 and 28 grams per liter;

maintaining the pH of said electrolytic bath between about 5.6 and 6.0 and the temperature of said electrolytic bath between about 100° F. and 120° F. (38° C. to 49° C. while electrodepositing iron onto said cathode to provide brittle, friable iron deposits on said cathode; and pulverizing said chips produced from the iron deposits to produce iron powder particles wherein said iron deposits are pulverized to a powder at least 50% by weight of particles less than −325 mesh (44 microns).

2. The process in claim 1 wherein the iron powder particles are pulverized to produce at least a 70% weight fraction of powder at less than 44 microns.

3. In an improved process for producing electrolytic iron powder from an aqueous electrolytic bath having an anode and a cathode and an electrolytic cell disposed between the anode and cathode, depositing electrolytic iron onto said cathode at a current density between about 10 amps and 30 amps per square foot of cathode surface, removing the deposited iron from the cathode as iron chips, and pulverizing the iron chips into powder to provide a preponderance of iron powder particles less than 44 microns, the improvement in the electrolytic process comprising:

providing an aqueous electrolytic bath containing ferrous sulfate measured as a ferrous ion concentration of at least about 34 grams of ferrous ion per liter and ammonium sulfate measured as ammonium ion ($NH_3$) concentration of less than about 28 grams per liter provided the ion concentration ratio of said ferrous ion to said ammonium ion is between about 1.4 and 1.6;

maintaining the pH of said electrolytic bath between about 5.6 and 6.0 and the temperature of said electrolytic bath between about 38° C. and 49° C. while electrodepositing iron onto said cathode to provide brittle, friable iron deposits on said cathode; and pulverizing said chips produced from the iron deposits to produce iron powder particles herein said iron deposits are pulverized to a powder containing at least about 50% by weight particles less than 44 microns.

* * * * *